US006277264B1

(12) United States Patent
Lorincz

(10) Patent No.: US 6,277,264 B1
(45) Date of Patent: Aug. 21, 2001

(54) SYSTEM AND METHOD FOR USING MULTIPLE LEAD CONNECTIONS IN AN ELECTROPOLISHING PROCESS

(75) Inventor: Thomas A. Lorincz, Hollister, CA (US)

(73) Assignee: Therma Corporation, Inc., San Jose, CA (US)

( * ) Notice: Subject to any disclaimer, the term of this patent is extended or adjusted under 35 U.S.C. 154(b) by 0 days.

(21) Appl. No.: 09/496,479

(22) Filed: Feb. 2, 2000

(51) Int. Cl.[7] ..... C25F 3/00

(52) U.S. Cl. ..... 205/679; 205/680; 205/681; 204/224 R; 204/224 M; 204/272

(58) Field of Search ..... 205/679, 680, 205/681; 204/224 R, 224 M, 272

(56) References Cited

U.S. PATENT DOCUMENTS

| | | | |
|---|---|---|---|
| 2,764,540 | 9/1956 | Farin et al. | 204/140.5 |
| 3,055,812 | 9/1962 | Andersson | 204/140.5 |
| 3,329,596 | 7/1967 | Abt et al. | 204/143 |
| 4,369,101 | 1/1983 | Wolff et al. | 204/224 |
| 4,645,581 | 2/1987 | Voggenthaler et al. | 204/275 |
| 4,705,611 | 11/1987 | Grimes et al. | 204/129.1 |
| 4,772,367 | 9/1988 | Menzel et al. | 204/129.5 |
| 4,826,582 | 5/1989 | Lavalerie et al. | 204/196 |
| 5,135,625 | 8/1992 | Lewy | 204/129.6 |
| 5,507,923 | 4/1996 | Stouse et al. | 205/679 |

*Primary Examiner*—Arun S. Phasge
(74) *Attorney, Agent, or Firm*—Henneman & Saunders; Larry E. Henneman, Jr.

(57) ABSTRACT

An electropolishing system for uniformly polishing the inner surface of a pipe includes an electrode for placement within the pipe, a plurality of electrical leads for coupling the pipe to a common voltage source, and a power supply. The power supply includes a first voltage supply terminal, for coupling to the electrode, and second voltage supply terminal, for coupling to the common voltage source. A disclosed method for electropolishing the inner surface of a pipe includes the steps of placing an electrode within the pipe, electrically coupling the pipe to a common voltage source with a plurality of electrical leads, coupling the electrode to a first voltage supply terminal of a power supply, coupling the common voltage source to a second voltage supply terminal of the power supply, and drawing the electrode through the pipe.

26 Claims, 8 Drawing Sheets

| Electrode Position | Distance (feet) | Resistance (ohms) | Voltage Pipe | Voltage Gap |
|---|---|---|---|---|
| *W* | *0* | *0.000* | *0.000* | *15.000* |
| | 50 | 0.002 | 0.271 | 14.729 |
| | 100 | 0.004 | 0.541 | 14.459 |
| *X* | *150* | *0.005* | *0.812* | *14.188* |
| | 200 | 0.007 | 1.083 | 13.917 |
| | 250 | 0.009 | 1.353 | 13.647 |
| *Y* | *300* | *0.011* | *1.624* | *13.376* |
| | 350 | 0.013 | 1.895 | 13.105 |
| | 400 | 0.014 | 2.165 | 12.835 |
| *Z* | *450* | *0.016* | *2.436* | *12.564* |

FIG. 2

SYSTEM AND METHOD FOR USING MULTIPLE LEAD CONNECTIONS IN AN ELECTROPOLISHING PROCESS

BACKGROUND OF THE INVENTION

1. Field of the Invention

This invention relates generally to electropolishing processes, and more particularly to a system and method for electropolishing the inner surface of a pipe. Even more particularly, the present invention relates to a system and method for maintaining process parameters (e.g., the electrode-pipe gap voltage within acceptable limits.

2. Description of the Background Art

FIG. 1 is a block diagram of a typical electropolishing system 100 for polishing the inner surface of a pipe 102. Electropolishing system 100 includes a power a power supply 104 having a first voltage supply terminal 106 and a second voltage supply terminal 108, a cable 110, an electrode 112, and an electrical lead 114. Electrode 112 is coupled to first voltage supply terminal 112 via cable 110, and pipe 102 is coupled to second voltage supply terminal 108 via electrical lead 114. An electrolyte solution (not shown) is circulated through pipe 102 during the electropolishing process by an electrolyte pumping system (not shown).

Power supply 104 asserts a first voltage, via first voltage supply terminal 106 and cable 110, on electrode 112, and a second voltage, via second voltage supply terminal 108 and electrical lead 114, on pipe 102. The voltage difference between electrode 112 and pipe 102 causes electrical current to flow from electrode 112, through the electrolyte solution (e.g., phosphoric acid or sulfuric acid solution), to pipe 102. The electrical current selectively removes microscopically raised points from the inner surface of pipe 102 (including any deposits thereon), into the electrolyte solution in the form of a soluble salt, effectively polishing the inner surface of pipe 102.

The amount of electrical current, and thus the amount of material removed from the inner wall of pipe 102, depends on the voltage difference between electrode 112 and pipe 102. When electrode 112 is in position W, close to the connection between pipe 102 and lead 114, the resistance of pipe 102 is negligible, so that the voltage difference between electrode 112 and pipe 102 is essentially equal to the voltage difference between first supply terminal 106 and second supply terminal 108. However, during the electropolishing process, electrode 112 is drawn through pipe 102 from position W to position X, to position Y, and finally to position Z. As electrode 112 is drawn away from position W the resistance of pipe 102 becomes a factor, reducing the voltage difference between electrode 122 and pipe 102. The changing voltage between electrode 112 and pipe 102 results in the nonuniform electropolishing of the inner surface of pipe 102.

FIG. 2 is a chart 200 showing the increased resistance of pipe 102, and the associated change in voltage across the electrolyte gap, as electrode 112 is drawn through pipe 102. The electrode positions (W, X, Y, Z) shown in chart 200 correspond to the positions illustrated in FIG. 1. The resistance (R) of pipe 102 was determined by the equation:

$$R=\rho(D/A), \qquad \text{(Eq. 1)}$$

where R is the resistance of pipe 102, ρ is the resistivity of the material of which pipe 102 is constructed, L is the length of pipe between the particular position and position W, and A is the cross-sectional area of pipe 102. For purposes of this example, ρ is taken as 2.362 micro-ohms per foot, the resistivity of type 304 stainless steel, and the cross-sectional area of pipe 102 is 0.0655 square feet. The voltage drop (V) through a particular section of pipe 102 is calculated using Ohm's law:

$$V=IR, \qquad \text{(Eq. 2)}$$

where (I) is the process current and (R) is the resistance of the relevant section of pipe 102.

The voltage between electrode 112 and pipe 102 (the gap voltage) is determined by subtracting the voltage drop across the particular pipe section from the voltage between first supply terminal 106 and second supply terminal 108 (the process voltage). Chart 200 shows that as the distance between electrode 112 and the junction between pipe 102 and lead 114 (position W) increases, the gap voltage decreases. The decreasing gap voltage results in the nonuniform electropolishing of the inner surface of pipe 102.

What is needed is an electropolishing system and method, wherein the gap voltage may be maintained within a desired range to achieve the uniform electropolishing of the inner surface of a pipe.

SUMMARY

The present invention overcomes the problems associated with the prior art by providing a novel system and method for uniformly electropolishing the inner surface of a pipe. The invention helps maintain the process voltage within a desired range by utilizing a plurality of electrical leads to achieve uniform electropolishing of the pipe. Coupling the pipe to a common voltage source with a plurality of electrical leads reduces the electrical resistance through the pipe by reducing the length of pipe through which the current must flow.

The embodiment of the present invention includes an electrode for placement within the pipe, a plurality of electrical leads, and a power supply having first and second voltage supply terminals. Each of the electrical leads is adapted to electrically couple a separate portion of the pipe to a common voltage source. The second voltage supply terminal of the power supply is also adapted to couple to the common voltage source. A cable electrically couples the electrode with the first voltage supply terminal of the power supply and draws the electrode through the pipe. In a particular embodiment the common voltage source is ground. In a more particular embodiment the electrical leads and/or the second voltage supply terminal of the power supply are adapted to facilitate separate grounding.

In another embodiment the plurality of electrical leads are adapted to couple to a single common voltage source, and in a more particular embodiment, the electrical leads are embodied in a single, electrically conductive cable. In an alternate embodiment, each of the electrical leads comprises an electrically conductive cable with a first end adapted to couple to the pipe to be electropolished and a second end adapted to couple to the common voltage source (e.g. a water pipe, grounded machinery, etc.). In a particular embodiment the first end of each of the leads is stripped of insulation and wrapped around the pipe to be electropolished. Alternatively, the first end of each of the leads includes a clamp for electrically engaging the pipe to be electropolished. In another particular embodiment the second end of each of the leads is stripped and wrapped around the common voltage source. Alternatively, the second end of each of the leads includes a clamp for electrically engaging the common voltage source.

A method for electropolishing the inner surface of a pipe is also disclosed. The method includes steps for placing an electrode within the pipe, attaching the pipe to a common voltage source with a plurality of electrical leads, coupling the electrode to the first voltage supply terminal of a power supply, coupling the common voltage source to a second voltage supply terminal of the power supply, and drawing the electrode through the pipe.

In a particular method the spacing between the electrical leads is dependent on the resistivity (ρ) of the pipe material and an acceptable variation in the voltage ($\Delta V_{gap}$) between the electrode and the pipe. In a more particular embodiment the spacing (L) between each of the leads is obtained by the equation $L \leqq (4A\Delta V_{gap})/(\rho I)$ where (I) is the process current and (A) is the cross sectional area of the pipe. Optionally, the leads are equally spaced.

According to one method, the common voltage source is maintained at ground. Optionally, each of the leads, and/or the second voltage supply terminal of the power supply are separately grounded.

In a particular method, the step of attaching the pipe to the common voltage source includes attaching each of the leads to a single common voltage source. According to another step of attaching a plurality of electrical leads to the pipe includes attaching separate portions of a single, conductive cable to associated portions of the pipe.

In another particular method, the step of attaching the pipe to the common voltage source with a plurality of electrical leads includes attaching the first end of each of the leads to the pipe and attaching the second end of each of the leads to the common voltage source. A more particular method for attaching the leads to the pipe includes wrapping an uninsulated first end of each of the leads around the pipe, or alternatively clamping the first end of each of the leads to the pipe. A particular method for coupling each of the leads to a common voltage source includes wrapping an uninsulated second end of each of the leads around the common voltage source, or alternatively clamping the second end of each of the leads to the common voltage source.

BRIEF DESCRIPTION OF THE DRAWINGS

The present invention is described with reference to the following drawings, wherein like reference numbers denote substantially similar elements:

FIG. 2 is a table showing the variation of resistance and pipe voltage as the distance between the electrical lead and electrode of FIG. 1 increases;

DETAILED DESCRIPTION

The present invention overcomes the problems associated with the prior art by maintaining the gap voltage (the voltage drop between the electrode and the pipe) in an electropolishing system within a desired range to achieve uniform polishing of the inner surface of a pipe. In the following description, numerous specific details are set forth (e.g. multiple methods for electrically engaging an electrical lead with the common voltage source or with the pipe to be electropolished) in order to provide a thorough understanding of the invention. Those skilled in the art will recognize, however, that the invention may be practiced apart from these specific details. In other instances, details of well known electropolishing practices (e.g. type and concentration of the electrolyte solution, particular process voltages, etc.) have been omitted, so as not to unnecessarily obscure the present invention.

Figure 1:
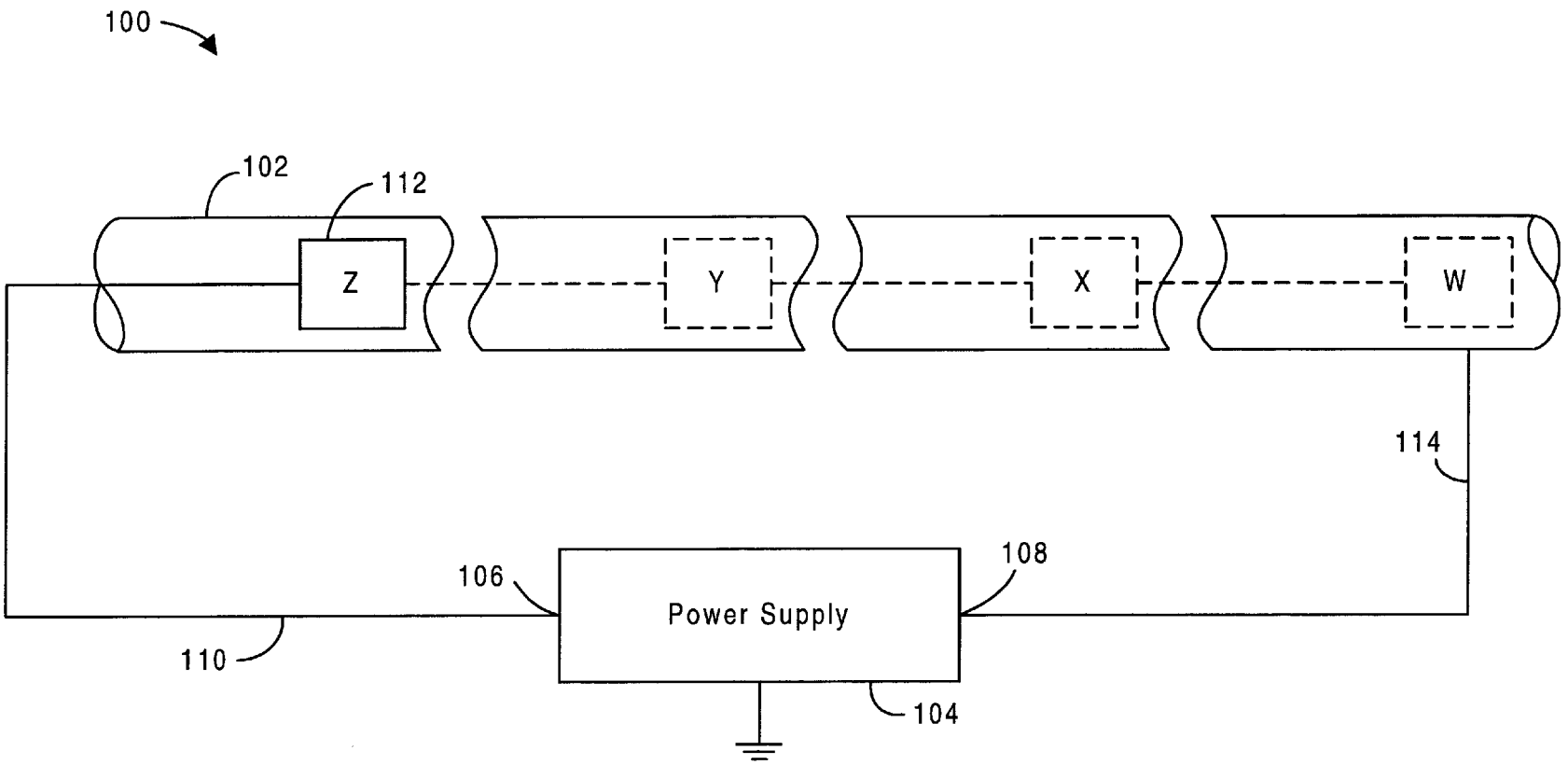
FIG. 1 PRIOR ART
FIG. 1 is a block diagram showing a known electropolishing system.
Figure 3:
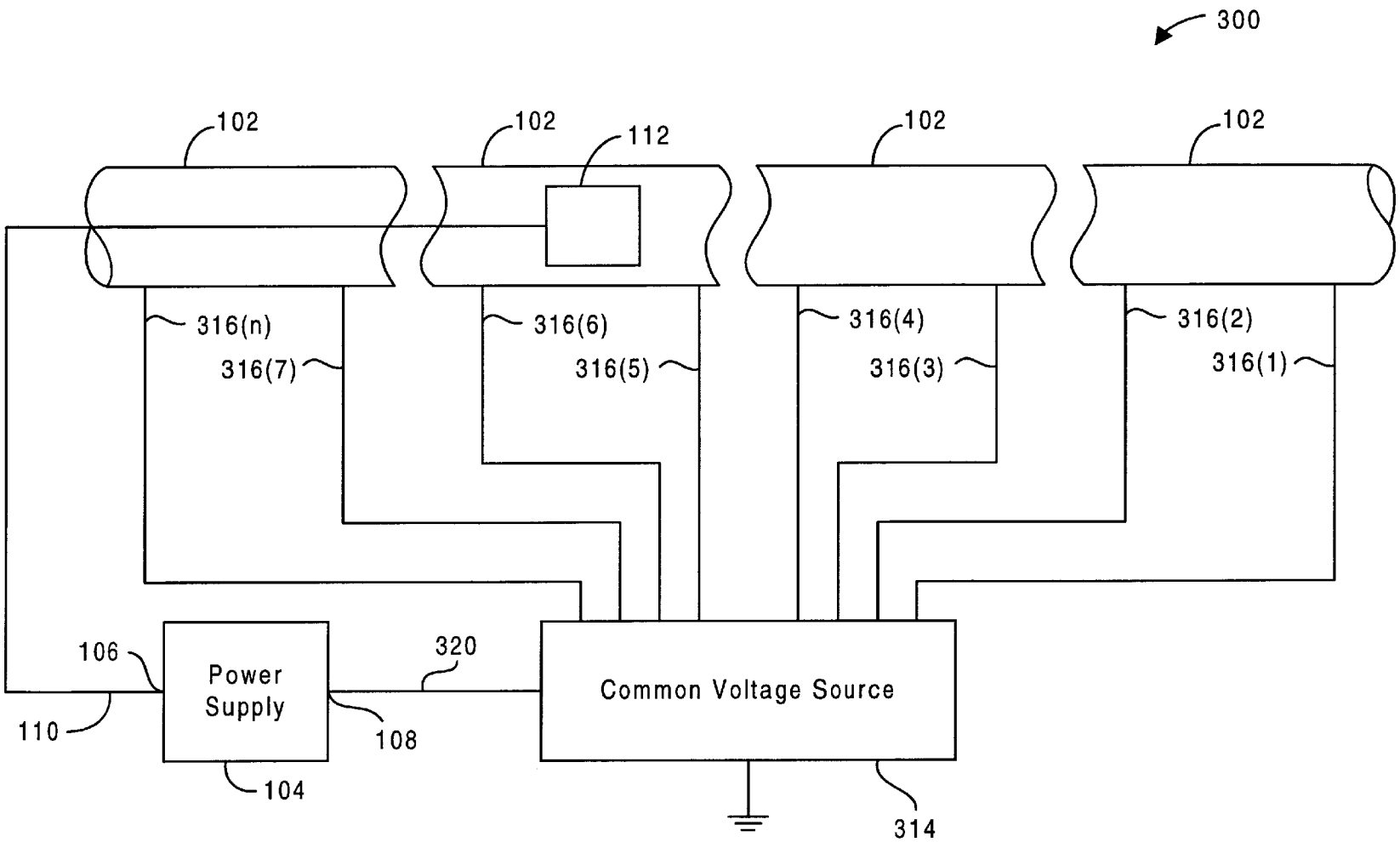
FIG. 3 is a block diagram showing an electropolishing system in accordance with the present invention.

FIG. 3 is a block diagram of an electropolishing system 300 for polishing the inner surface of pipe 102. Electropolishing system 300 includes a power supply 104 having a first voltage supply terminal 106 and a second voltage supply terminal 108, a cable 110, an electrode 112, a common voltage source 314 and a plurality of electrical leads 316(1 to n). Electrical leads 316(1 to n) each include a first end for electrically coupling to pipe 102 and a second end for electrically coupling to common voltage source 314. Electrode 112 is electrically coupled to first voltage supply terminal 106 of power supply 104 via cable 110. Power supply 104 is electrically coupled via cable 320 to common voltage source 314. In this particular embodiment, common voltage source 314 is maintained at ground.

As used herein, the term "common voltage source" is understood to include any object that can serve as a potential reference. For example, objects that may serve as common voltage source 314 include, but are not limited to, a grounded piece of industrial equipment, a grounded building frame, a single conductive cable, or any other object that will serve as a convenient reference voltage source.

Power supply 104 asserts a first voltage (with respect to common voltage source 314), via first voltage supply terminal 106 and cable 110, on electrode 112. A second voltage is asserted on pipe 102 by common voltage source 314 via electrical leads 316(1) through 316(n). The voltage difference between charged electrode 112 and pipe 102 causes an electrical current to flow from electrode 112, through the electrolyte (not shown), to pipe 102. As electrode 112 is pulled through pipe 102 by cable 110, electrical leads 316(1 to n) maintain the gap voltage between electrode 112 and pipe 102 within a desired range by reducing the length of pipe 102 through which the current must flow. Electrical leads 316(1 to n) are spaced at intervals determined to regulate the gap voltage at electrode 112 in a desired range that provides uniform electropolishing. In this particular embodiment, each adjacent pair of electrical leads 316(1 to n) are equally spaced. Those skilled in the art will recognize, however, that variation in the spacing of associated pairs of electrical leads 316(1 to n) is tolerable, so long as the gap voltage is maintained within the desired range.

Figure 4:
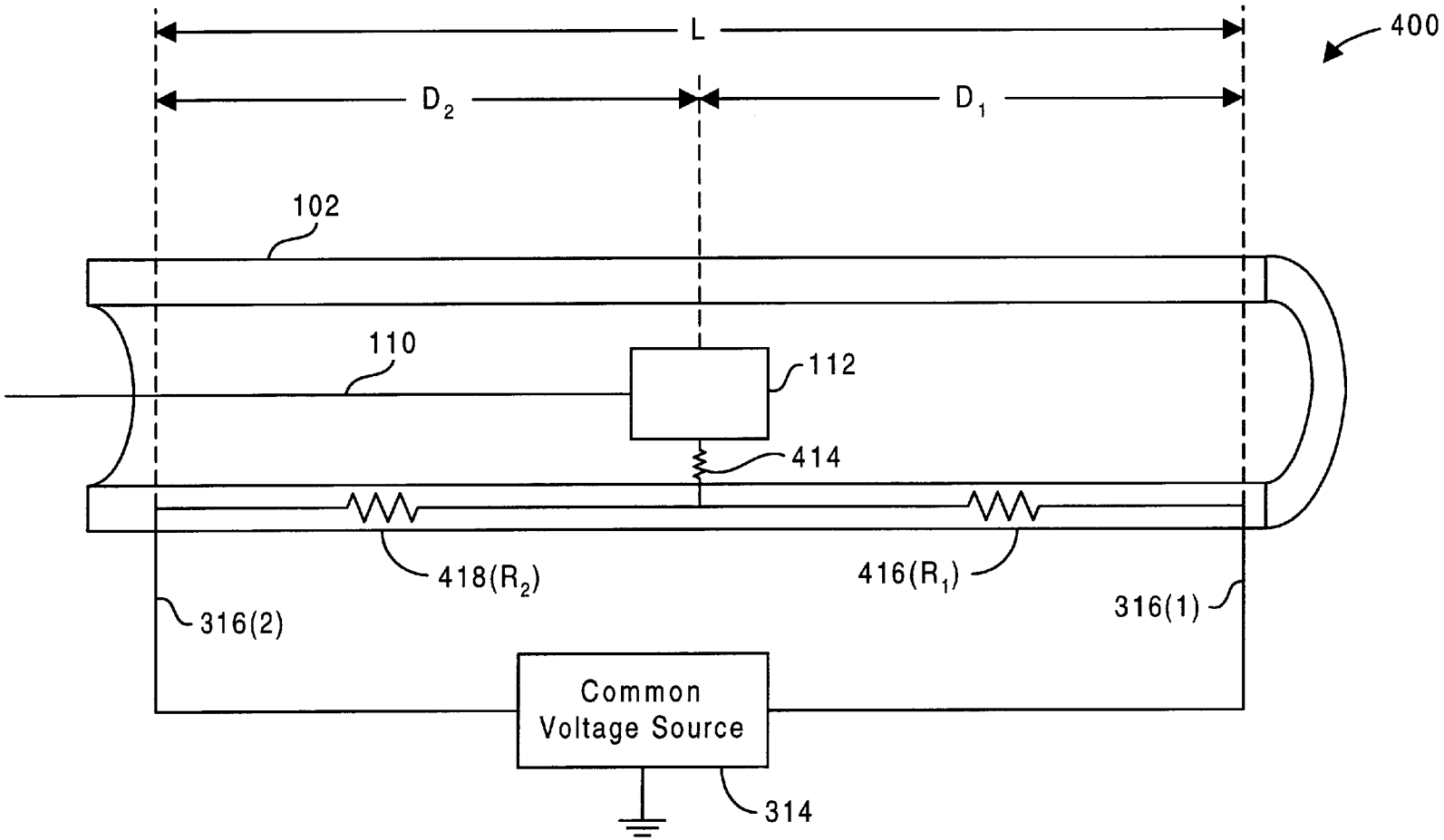
FIG. 4 is a circuit diagram showing a portion of the process current path in the electropolishing system of FIG. 3.

FIG. 4 shows a circuit diagram 400 for process current flow through an adjacent pair of electrical leads in electropolishing system 300. Circuit diagram 400 includes a cross sectional portion of pipe 102, cable 110, electrode 112, electrical leads 316(1) and 316(2), a resistor 414 representing the gap resistance, and resistors 416 (R1) and 418 (R2), representing the resistance through the respective portions of pipe 102.

During the electropolishing process power supply 104 asserts a voltage, via cable 110, on electrode 112. The voltage difference between electrode 112 and common voltage source 314 causes current to flow between electrode 112 and common voltage source 314. Assuming the resistance of leads 316(1) and 316(2) is negligible, the electrical resistance between electrode 112 and common voltages source 314 is the sum of gap resistance 414 and the total resistance through pipe 102. For a relatively constant gap resistance 414, the amount of current, and therefore the gap voltage, depends on the total pipe resistance. When electrode 112 is near a lead attachment, the resistance of pipe 102 is negligible. As the electrode 112 moves away from the point of lead attachment, the increased pipe resistance results in a voltage drop ($V_{pipe}$) through pipe 102. Because the voltage between electrode 112 and common voltage source 314 is equal to the sum of the gap voltage ($V_{gap}$) and the voltage drop ($V_{pipe}$) through pipe 102, the pipe voltage ($V_{pipe}$) must be maintained at or below the acceptable variation in gap voltage.

For a known acceptable gap voltage ($V_{gap}$) range, the spacing (L) between adjacent electrical leads 316(1) and 316(2) can be determined as follows. The voltage drop through pipe 102 ($V_{pipe}$) is equal to the product of the process current (I) and the pipe resistance $R_{pipe}$, as given by Ohm's Law:

$$V_{pipe}=I\,R_{pipe} \qquad \text{(Eq. 3)}$$

The resistance $R_{pipe}$ of pipe 102 is equal to the resistance of resistors 416($R_1$) and 418($R_2$), in parallel. The first resistance ($R_1$) represents the section of pipe 102 between electrode 112 and electrical lead 316(1), and the second resistance ($R_2$) represents the section of pipe 102 between electrode 112 and electrical lead 316(2). The total pipe resistance of pipe 102 ($R_{pipe}$) is therefore given by the following equation for parallel resistors:

$$R_{pipe} = \frac{R_1 R_2}{R_1 + R_2} \qquad \text{(Eq. 4).}$$

Substituting Equation 4 into Equation 3 yields:

$$V_{pipe} = I\,\frac{R_1 R_2}{R_1 + R_2} \qquad \text{(Eq. 5).}$$

The resistance of a particular section of pipe is given by the following equation:

$$R = \frac{\rho D}{A} \qquad \text{(Eq. 6).}$$

wherein (ρ) is the resistivity of pipe 102, (D) is the distance between electrode 112 and one of electrical leads 316, and (A) is the cross sectional area of pipe 102.

Substituting Equation 6 into Equation 5 for each of resistances $R_1$ and $R_2$ yields:

$$V_{pipe} = I\,\frac{[(\rho D_1)/A][(\rho D_2)/A]}{[(\rho D_1)/A] + [(\rho D_2)/A]} \qquad \text{(Eq. 7).}$$

wherein ($D_1$) is the associated length of pipe 102 between electrode 112 and lead 316(1), ($D_2$) is the associated length of pipe 102 between electrode 112 and lead 316(2), (ρ) is the resistivity of pipe 102, and (A) is the cross sectional area of pipe 102.

Simplifying equation 7 yields:

$$V_{pipe} = I\,\frac{[(\rho D_1 D_2)]}{[(D_1 + D_2)A]} \qquad \text{(Eq. 8).}$$

The maximum voltage drop ($V_{pipe}$) through pipe 102 occurs when $D_1=D_2$ (i.e., when electrode 112 is halfway between leads 316(1) and 316(2). When $D_1=D_2$ then $D_1=D_2=(L/2)$, wherein (L) is length between electrical leads 316(1) and 316(2). Substituting (L/2) for $D_1$ and $D_2$ in Equation 8 and simplifying yields:

$$V_{pipe} = \frac{IL\rho}{4A} \qquad \text{(Eq. 9).}$$

The voltage drop ($V_{pipe}$) through pipe 102 must be maintained at or below the maximum acceptable change in the gap voltage ($\Delta V_{gap}$). Therefore:

$$\Delta V_{gap} \le \frac{IL\rho}{4A} \qquad \text{(Eq. 10).}$$

Solving for L yields:

$$L \le \frac{4A(\Delta V_{gap})}{\rho I} \qquad \text{(Eq. 11).}$$

Finally, for a given pipe resistivity (ρ), pipe cross-sectional area (A), process current (I), and maximum acceptable variation in the gap voltage ($\Delta V_{gap}$), the maximum spacing (L) between two adjacent leads 316(n) and 316(n+1) can be determined from Equation 11.

Figure 5:
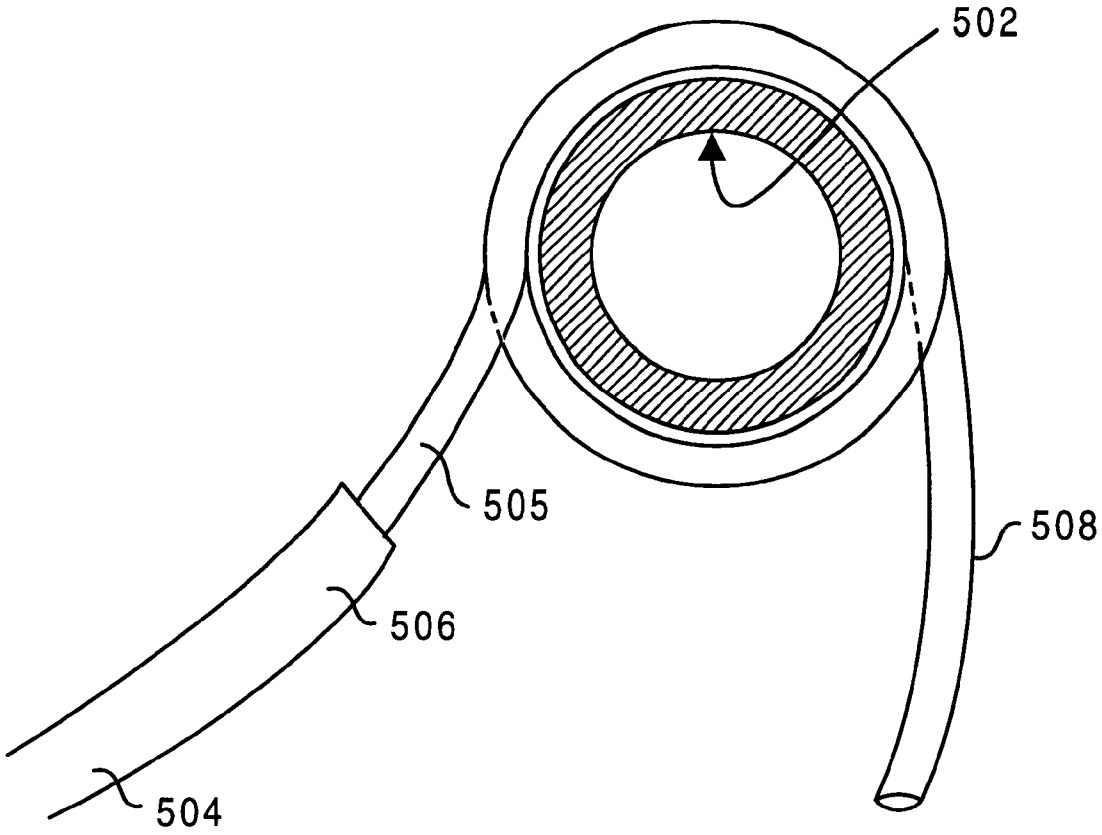
FIG. 5 shows an electrical lead coupled to a pipe according to the present invention.

FIG. 5 is an axial view of a pipe 502 showing one particular method for electrically coupling an electrical lead 504 to pipe 502. Electrical lead 504 includes a conductive wire 505 (e.g. solid core or multistrand copper) covered by an insulating sheath 506. A portion of insulating sheath 506 is removed from a terminal portion 508 of lead 504. Terminal portion 508 is then wound about pipe 502, to establish an electrical connection between lead 504 and pipe 502, thus providing a path for the electropolishing process current.

While this particular method is particularly simple and convenient, those skilled in the art will recognize that care must be taken to insure that both wire 505 and the exterior surface of pipe 502 are clean so as to facilitate a highly conductive connection. Optionally, an electrically conductive paste may be applied to the connection to reduce undesirable electrical resistance. Wire 505 should be wrapped tightly around pipe 502 and the rigidity of wire 505 should be sufficient to maintain good contact between pipe 502 and lead 504.

The illustrated method is suitable for electrically coupling lead 504 to the pipe to be electropolished, as well as to the common voltage source. Pipe 502 is understood, therefore, to represent either the pipe to be electropolished, or a component of common voltage source 314 (e.g., a cold water pipe, a grounded safety rail, etc.) in electropolishing system 300.

Figure 6:
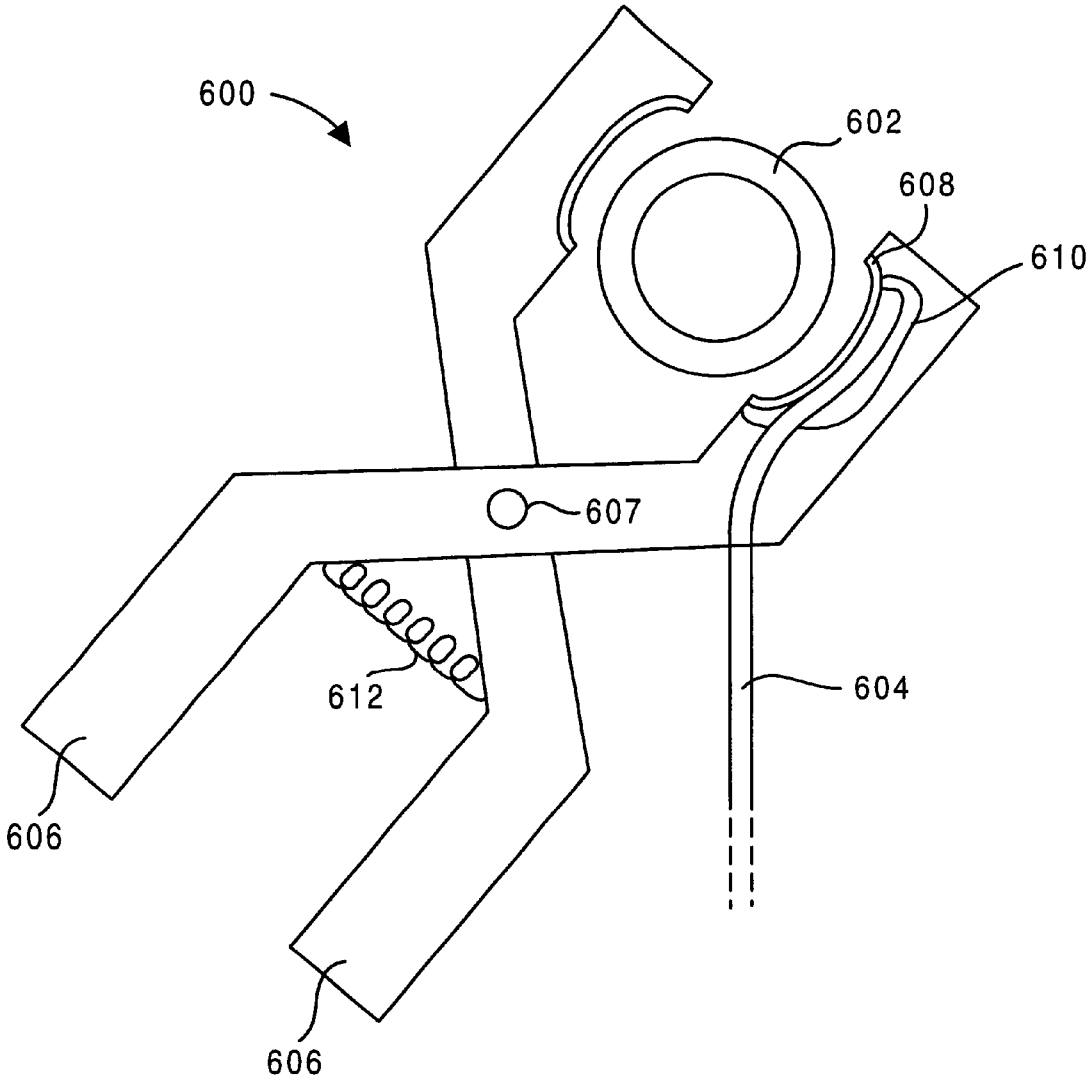
FIG. 6 shows a clamp for coupling of an electrical lead with a pipe in accordance with the present invention.

FIG. 6 is a side view of a clamp 600 electrically coupling an electrical lead 604 to a pipe 602. Pipe 602 is understood to represent either the pipe being electropolished, or a component of common voltage source 314.

Clamp 600 includes a pair of offset arms 606, held in scissor-like relationship with one another by a pivot pin 607. One end of each of arms 606 work together as clamp handles, and the opposite ends of each of arms 606 work together as clamp jaws. At least one of the clamp jaws includes an electrically conductive insert 608 for electrically engaging pipe 602. Lead 604 is electrically coupled to insert 608 by a solder joint 610. Clamp 600 further includes a biasing member 612 (e.g., a spring) disposed to exert outward pressure on the handle portions of arms 606, thus providing a clamping force between jaw insert 608 and pipe 602.

Figure 7:
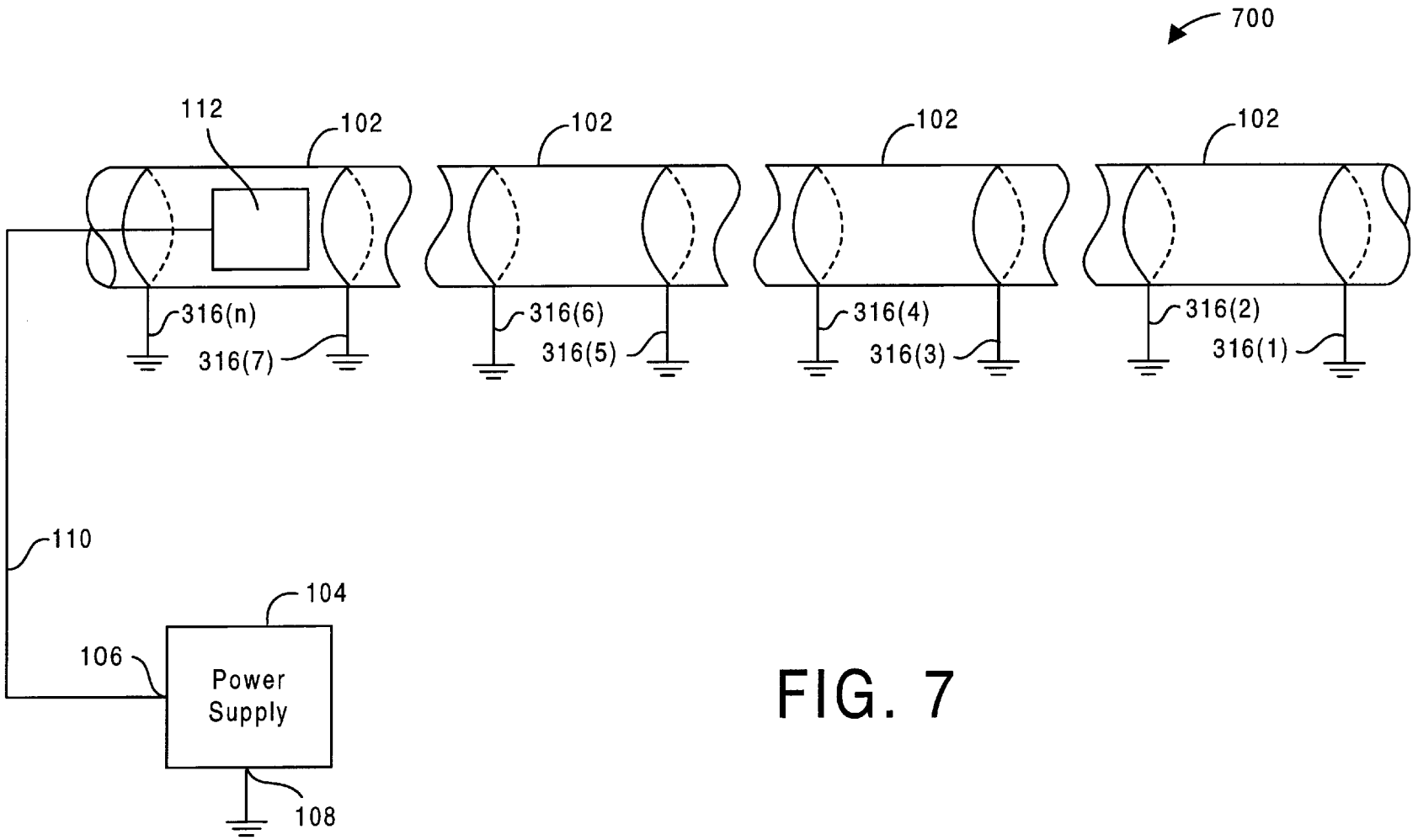
FIG. 7 is a block diagram of an alternate electropolishing system according to the present invention.

FIG. 7 is a block diagram of an alternate electropolishing system 700 according to the present invention. System 700 is similar to system 300, except that each of electrical leads 316(1–n) and second supply terminal 108 of power supply 104 are separately grounded (i.e., common voltage source 314 is the earth). System 700 has the advantage that leads 316(1–n) can be attached to any convenient source of ground (e.g., grounded machinery, cold water pipe, grounded building frame, etc.). Thus, leads 316(1–n) can be relatively shorter in length, because they only need reach the nearest, most convenient source of ground.

Figure 8:
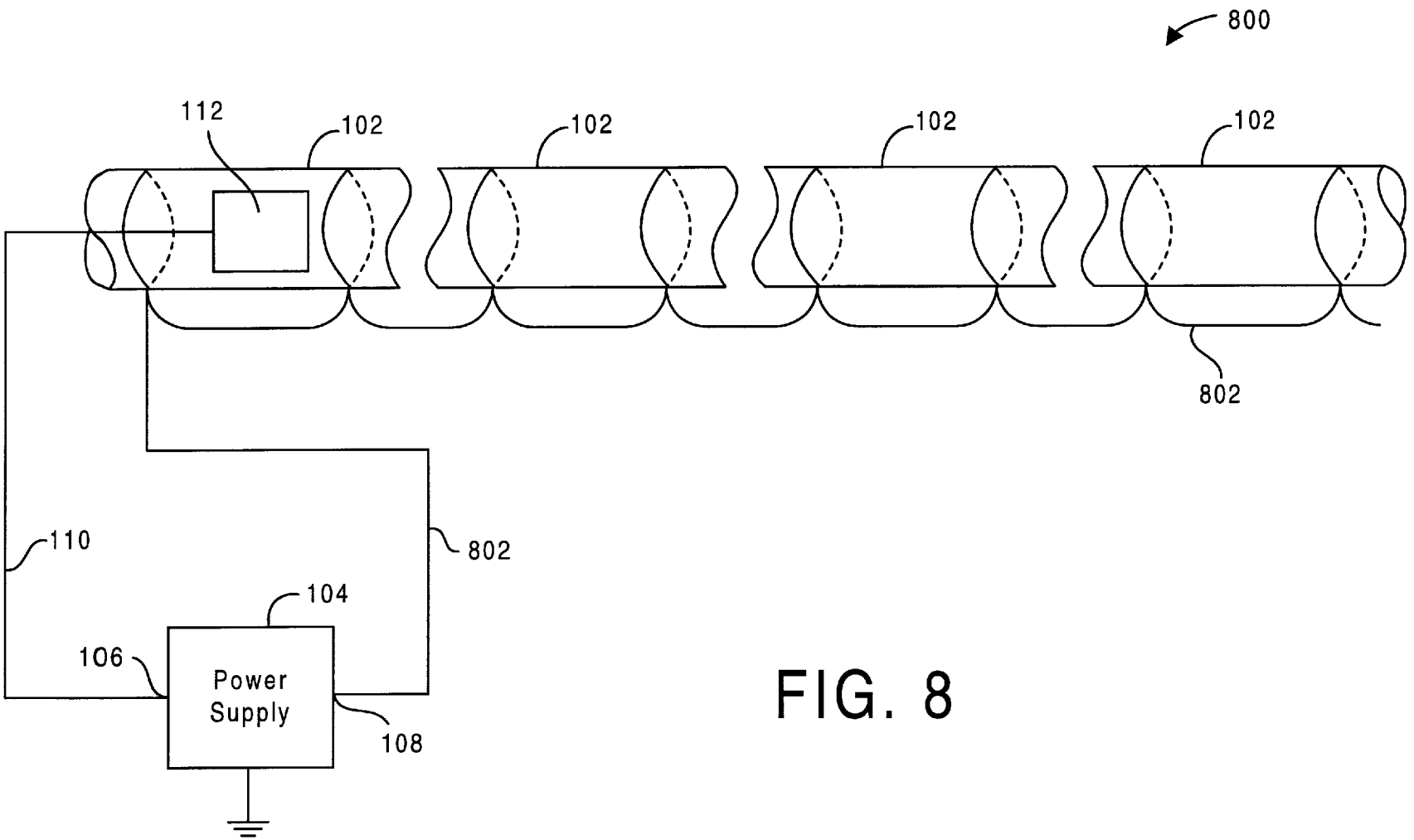
FIG. 8 is a block diagram of another alternate electropolishing system according to the present invention.

FIG. 8 is a block diagram of an alternate electropolishing system 800 according to the present invention. System 800 is similar to system 300, except that each of electrical leads 316(1–n) are embodied in a single electrically conductive cable 802 that is connected to second voltage supply terminal 108 of power supply 104. Uninsulated portions 804(1–n) of cable 802 electrically engage (by wrapping, clamping, or the like) associated portions of pipe 102.

The description of particular embodiments of the present invention is now complete. Many of the described features may be substituted, altered or omitted without departing from the scope of the invention. For example, alternate electrical leads (e.g., aluminum conductors), may be substituted for the copper leads disclosed. These and other deviations from the particular embodiments shown will be apparent to those skilled in the art, particularly in view of the foregoing disclosure.

What is claimed is:

1. An electropolishing system, for polishing the inside of a pipe, comprising:

an electrode for placement within the pipe;

a plurality of electrical leads, each adapted to electrically couple a separate portion of said pipe to a common voltage source; and a power supply having a first voltage supply terminal adapted to couple to said electrode, and a second voltage supply terminal adapted to couple to said common voltage source.

2. An electropolishing system according to claim 1, further comprising a cable for electrically coupling said electrode to said first voltage supply terminal and for drawing said electrode through said pipe.

3. An electropolishing system in accordance with claim 1, wherein said common voltage source is ground.

4. An electropolishing system in accordance with claim 3, wherein at least two of said leads are adapted to facilitate separate grounding.

5. An electropolishing system in accordance with claim 4, wherein said second voltage supply terminal is adapted to facilitate separate grounding.

6. An electropolishing system in accordance with claim 1, wherein said leads are adapted to couple to a single common voltage source.

7. An electropolishing system in accordance with claim 1, wherein said leads are embodied in a single, electrically conductive cable.

8. An electropolishing system in accordance with claim 1, wherein each of said leads comprises an electrically conductive cable having a first end adapted to couple to said pipe and a second end adapted to couple to said common voltage source.

9. An electropolishing system in accordance with claim 8, wherein said first end of each of said cables is adapted to be wrapped around said pipe.

10. An electropolishing system in accordance with claim 8, wherein said first end of each of said cables includes a clamp, for electrically engaging said pipe with said first end of said cable.

11. An electropolishing system in accordance with claim 8, wherein said second end of each of said cables is adapted to be wrapped around said common voltage source.

12. An electropolishing system in accordance with claim 8, wherein said second end of said cable includes a clamp for electrically engaging said common voltage source with said second end of said cable.

13. A method for electropolishing the inner surface of a pipe, comprising:

placing an electrode in said pipe;

attaching said pipe to a common voltage source with a plurality of electrical leads;

coupling said electrode to a first voltage supply terminal of a power supply;

coupling said common voltage source to a second supply terminal of said power supply; and drawing said electrode through said pipe.

14. A method for electropolishing the inner surface of a pipe according to claim 13, wherein said leads are attached to said pipe at equally spaced intervals.

15. A method for electropolishing the inner surface of a pipe according to claim 13, wherein the spacing between each of said leads depends on the resistivity of said pipe and an acceptable variation in voltage between said electrode and said pipe.

16. A method for electropolishing the inner surface of a pipe according to claim 15, wherein the distance between each of said leads, L, is determined by the formula:

$$L \leq \frac{4A(\Delta V_{gap})}{\rho I},$$

wherein $\Delta V_{gap}$ is a maximum acceptable difference between a process voltage and a gap voltage, A is the cross sectional area of said pipe, ρ is the resistivity of the pipe material, and I is the process current.

17. A method for electropolishing the inner surface of a pipe according to claim 13, wherein said common voltage source is maintained at ground.

18. A method for electropolishing the inner surface of a pipe according to claim 17, wherein said step of attaching said pipe to said common voltage source includes separately grounding each of said leads.

19. A method for electropolishing the inner surface of a pipe according to claim 17, wherein said step of coupling said common voltage source to said second voltage supply terminal of said power supply includes separately grounding said second voltage supply terminal.

20. A method for electropolishing the inner surface of a pipe according to claim 13, wherein said step of attaching said pipe to said common voltage source includes attaching each of said leads to a single common voltage source.

21. A method for electropolishing the inner surface of a pipe according to claim 13, wherein said step of attaching a plurality of electrical leads to said pipe includes attaching separate portions of a single conductive cable to associated separate portions of said pipe.

22. A method for electropolishing the inner surface of a pipe according to claim 13, wherein said step of attaching said pipe to said common voltage source with a plurality of electrical leads includes:

attaching a first end of each of said leads to an associated portion of said pipe; and attaching a second end of each of said leads to said common voltage source.

23. A method for electropolishing the inner surface of a pipe according to claim 22, wherein said step of attaching said first end of each of said leads to said pipe includes wrapping an uninsulated portion of said first end of each of said leads around each said associated portion of said pipe.

24. A method for electropolishing the inner surface of a pipe according to claim 22, wherein said step of attaching said first end of each of said leads to said pipe includes clamping said first end of each of said leads to each said associated portion of said pipe.

25. A method for electropolishing the inner surface of a pipe according to claim 22, wherein said step of attaching said second end of each of said leads to said common voltage source includes wrapping an uninsulated portion of said second end of each of said leads around said common voltage source.

26. A method for electropolishing the inner surface of a pipe according to claim 22, wherein said step of attaching said second end of each of said leads to said common voltage source includes clamping said second end of each of said leads to said common voltage source.

* * * * *